United States Patent [19]

Carson

[11] 4,365,502

[45] Dec. 28, 1982

[54] WIRE DRAWING DIE AND METHOD OF MAKING THE SAME

[75] Inventor: Charles Carson, Fort Wayne, Ind.

[73] Assignee: Fort Wayne Wire Die, Inc., Fort Wayne, Ind.

[21] Appl. No.: 208,198

[22] Filed: Nov. 19, 1980

[51] Int. Cl.[3] ..... B21C 3/02; B21K 5/20; B22F 7/04

[52] U.S. Cl. ..... 72/467; 76/107 A

[58] Field of Search ..... 76/107 A, 107 R, 101 R, 76/101 B, DIG. 12; 72/467; 29/420, DIG. 31

[56] References Cited

U.S. PATENT DOCUMENTS

| | | | |
|---|---|---|---|
| 2,003,475 | 6/1935 | Shipp | 205/29 |
| 2,171,323 | 8/1939 | Wyland | 76/107 A |
| 2,216,652 | 10/1940 | Romp | 76/107 A |
| 2,778,250 | 1/1957 | Ploegsma | 76/107 A |
| 3,978,744 | 9/1976 | Zachman | 76/107 A |
| 4,129,052 | 12/1978 | Bieberich | 76/107 A |

FOREIGN PATENT DOCUMENTS

| | | | |
|---|---|---|---|
| 522924 | 3/1956 | Canada | 76/107 A |
| 667809 | 3/1952 | United Kingdom | 76/107 A |

*Primary Examiner*—Roscoe V. Parker

*Attorney, Agent, or Firm*—Gust, Irish, Jeffers & Hoffman

[57] ABSTRACT

A wire drawing die and method for making the same in which a blank having a cylindrical core of a hard, wear-resistant material located randomly in the blank is initially attached to a circular metal plate having a concentric central opening, thus forming an assembly with the core being concentric to both the plate and the opening. A metal casing is provided having a cylindrical cavity proportioned to accommodate the plate with a close fit. A first brazing disc is placed on the cavity bottom. The assembly is inserted in the case cavity over the first brazing disc with the blank facing either toward the top or bottom of the cavity. Powder metal may be placed between the blank and the cavity. A second brazing disc is then placed over the assembly and the powder metal. A metal plug is provided with its outside diameter proportioned for a close fit with the case cavity and may have an interior cavity proportioned to accommodate the blank. The plug and casing are joined by the application of heat and pressure which melts the brazing material and partially melts and compacts the powder metal encapsulating the blank. Openings extending to the core through the plug and casing are provided. The core is drilled to communicate between the openings, the core being concentric to the outside diameter of the case.

32 Claims, 12 Drawing Figures

WIRE DRAWING DIE AND METHOD OF MAKING THE SAME

BACKGROUND OF THE INVENTION

1. Field of the Invention

This invention relates generally to wire drawing dies and methods of making such dies, and more particularly to a wire drawing die employing an irregular-shaped die element, and the method of making the same.

2. Description of the Prior Art

Wire drawing dies employing natural or man-made diamonds have been manufactured for many years, typically comprising a metal casing in which the diamond is mounted, the casing being adapted to be mounted in a wire drawing machine. U.S. Pat. No. 4,129,052 assigned to the assignee of the present application discloses a method of making a wire drawing die employing a synthetic hard, wear-resistant material such as a polycrystalline aggregate of synthetic diamond sold by the General Electric Company under the trademark Compax. In accordance with the method disclosed in that patent, a metal casing is provided having a flat-bottomed cavity machined therein, the side wall of the cavity adjacent the bottom being undercut. A first layer of metal powder is deposited in the casing covering the bottom and a metal blank having a core formed of synthetic hard, wear-resistant material is placed on the first layer with the core concentric with the cavity. A second layer of metal powder is deposited in the cavity covering the first layer and blank. A cylindrical plug is provided having a close fit with the casing cavity, one end of the plug having a cylindrical cavity formed therein. The plug is inserted in the casing cavity with the plug cavity facing the second metal powder layer, pressure is applied to the plug to compress the metal powder layer, and the casing and the plug are heated for a time and at a temperature sufficient partially to melt the metal powder thus forming a body of consolidated metal which encapsulates the blank. The casing is then cooled to solidify the metal body thereby to secure the blank and plug in the casing cavity. Countersunk openings are formed in the casing and the plug respectively extending to the core, and a die opening is drilled through the core communicating between the countersunk openings.

Some of the General Electric Compax die blanks have an irregular shape, such as the segment of a circle configuration shown in the aforesaid U.S. Pat. No. 4,129,052, and accurately centering such irregularly shaped die blanks in the casing cavity has been difficult and time consuming, and thus costly. It is therefore desirable to provide a method for quickly and precisely locating and mounting irregularly-shaped die elements, including synthetic hard, wear-resistant material and natural diamond, in the cavity of a die casing.

SUMMARY OF THE INVENTION

In accordance with the method of the invention, in its broader aspects, a circular metal plate is provided and a die element is centered with respect to the plate and adhered thereto. A metal die casing is provided having front and back sides and a cylindrical cavity is formed in the front casing side having a bottom spaced from the back casing side. The plate is concentrically placed in the cavity on the bottom thereof with the die facing the front casing side. A cylindrical metal plug is provided having opposite ends and an outside diameter proportioned to have a close fit with the casing cavity. The plug is inserted in the cavity with one end thereof defining a chamber with the cavity bottom with the plate and die element disposed therein. The plate and die element are secured in the chamber following which countersunk openings are formed in the back casing side on the other end of the plug which respectively extend to the die element, and a die opening is drilled through the die element communicating between the countersunk openings.

In the preferred embodiment of the invention, the casing cavity is proportioned to accommodate the plate with a close fit and a layer of metal powder is deposited in the cavity covering the plate and the die element. Pressure is applied to the other end of the plug thereby to compress the metal powder layer. The casing and plug are simultaneously heated for a time and at a temperature sufficient partially to melt the powder to form a body of consolidated metal filling the chamber and encapsulating the die element, the casing and plug thereafter being cooled under pressure to solidify and further consolidate the metal body.

In accordance with a further preferred embodiment of the invention, the die element comprises an irregularly-shaped blank having a cyclindrical core formed of synthethic, hard, wear-resistant material, the metal plate has a central opening therein with a diameter smaller than the diameter of the core, and the core is visually centered with respect to the opening in the plate prior to adhering the blank thereto to form a die blank-plate assembly. An undercut is formed in the bottom of the cavity adjacent the side wall and the plug has a cavity in its one end having a diameter greater than the maximum transverse dimension of the die blank and a thickness at least equal to the thickness of the die blank. Further, discs of brazing material are placed on the bottom of the casing cavity with the die blank-plate assembly and metal powder being placed thereover. Another disc of brazing material is placed over the metal powder.

It is accordingly an object of the invention to provide an improved method of making a wire drawing die incorporating an irregularly-shaped die element.

Another object of the invention is to provide an improved wire drawing die incorporating any irregularly-shaped die element.

A further object of the invention is to provide an improved method of making a wire drawing die in which an irregularly-shaped die element is quickly and precisely concentrically located in the cavity of a die casing.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
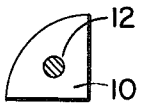
FIG. 1 is a top view of a typical General Electric Compax die blank segment which may be employed in the method and product of the invention.
Figure 2A:
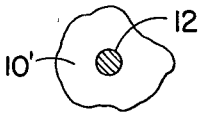
FIGS. 2A and 2B are top views of other irregularly-shaped die blanks which may be employed.
Figure 2B:
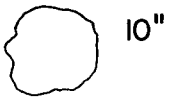
Figure 4:
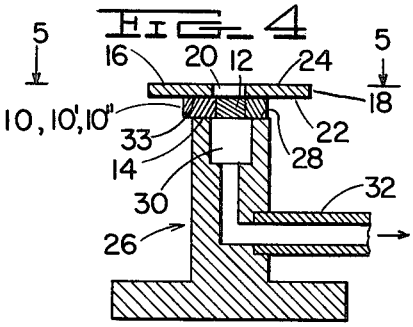
FIG. 4 is a side, cross-sectional view showing the preferred procedure for centering the die blank of FIG. 1 with respect to the centering plate of FIG. 3A.

Referring now to FIG. 1, there is shown a typical General Electric Compax blank 10 having a segment shape and a cylindrical core 12 formed of synthetic hard wear-resistant material, such as a polycrystalline aggregate of synthetic diamond. Blank 10 is preferably formed of tungsten carbide and has flat opposite sides 14, 16, as shown in FIG. 4. FIG. 2A shows another irregularly-shaped die blank 10′ having core 12 formed of synthetic, hard, wear-resistant material. As shown in FIG. 2B, blank 10″ may be entirely a natural diamond or any other single or multi-layered hard, wear-resistant material with either a geometric or an irregular shape rather than the shape of blank 10. It will also be understood that core 12 may be a natural diamond or any other hard, wear-resistant material suitable for wire drawing applications, and that the material surrounding the core may be any other material suitable for supporting the core.

Figure 3A:
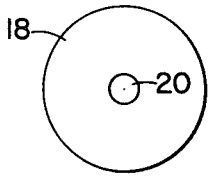
FIGS. 3A and 3B are top views of centering plates employed in the method and product of the invention.
Figure 3B:
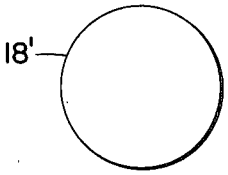

Referring now to FIG. 3A, there is shown circular centering plate 18 preferably having central opening 20 with an inside diameter slightly larger than the outside diameter of core 12. Central opening 20 may be eliminated, as shown in FIG. 3B. Centering plate 18 has flat opposite sides 22, 24, as shown in FIG. 4. In a physical embodiment of the invention, the inside diameter of central opening 20 of plate 18 was about 0.002 inch larger than the outside diameter of core 12.

Referring now to FIG. 4, vacuum holding fixture 26 is shown having flat surface 28 with vacuum passage 30 communicating therewith, vacuum line 32 adapted to be connected to a vacuum source (not shown) being coupled to vacuum passage 30, as shown.

Figure 5:
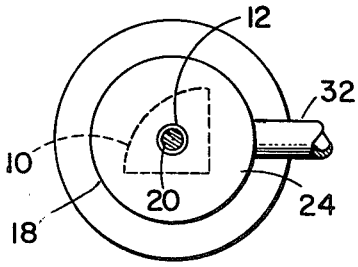
FIG. 5 is a top view taken generally along the line 5—5 of FIG. 4.
Figure 6:
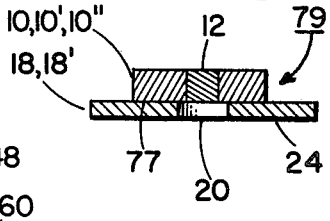
FIG. 6 is a cross-sectional view of the completed die blank-plate assembly.

In the preferred embodiment of the method of the invention, die blank 10, 10′, 10″ has its side 14 placed on surface 28 of vacuum holding fixture 26. Drops of a quick drying adhesive 33, such as a cyanoacrylate, are placed on the outer corners of side 16 of die blank 10, 10′, 10″ care being taken to avoid placing the adhesive on core 12 of blank 10, 10′. Centering plate 18 is then manually held over die blank 10, 10′ with core 12 being viewed through a low-power magnifier, and centering plate 18 is then manually manipulated until core 12 is observed to be centrally located within center opening 20, i.e., with the periphery of core 12 appearing to be equally spaced around the interior of center opening 20, as shown in FIG. 5. Gentle pressure is then applied to centering plate 18 so that side 22 engages the adhesive on side 16 of die blank 10, 10′, 10″, the pressure being maintained for a few seconds in order to set the adhesive. The assembly of centering plate 18 and die blank 10, 10′ is then removed from vacuum holding fixture 26 to form die blank-plate assembly 79, as shown in FIG. 6. It has been found in practice that completed die blank-plate assemblies, as shown in FIG. 6, can be produced at a rate of about six per minute with a centering accuracy greater than plus or minus 0.001 inch.

Figure 7:
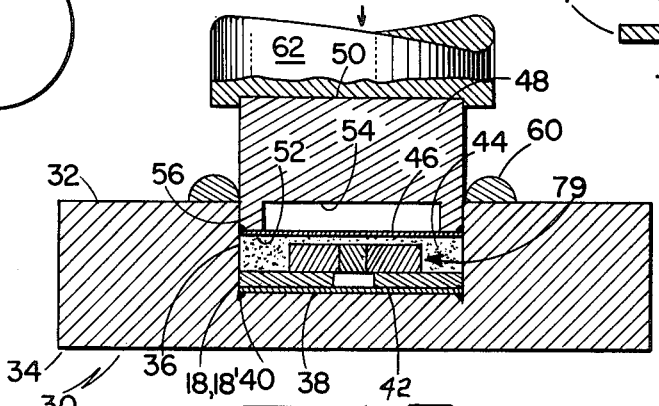
FIG. 7 is a cross-sectional view further illustrating the method of the invention.

Referring now to FIG. 7, cylindrical metal casing 30 is provided preferably, but not necessarily, formed of stainless steel. Casing 30 has flat, parallel, front and back sides 32, 34. Cylindrical cavity 36 is formed in front side 32 of casing 30 and has flat bottom 38 spaced from and parallel with back side 34. Bottom 38 of cavity 36 is undercut adjacent the side wall of cavity 36, as at 40. The inside diameter of cavity 36 is proportioned with respect to the outside diameter of centering plate 18, 18′ so as to provide a close fit of centering plate 18, 18′ in cavity 36. In a physical embodiment, the inside diameter of cavity 36 was about 0.002 inch larger than the outside diameter of centering plate 18.

Figure 9:
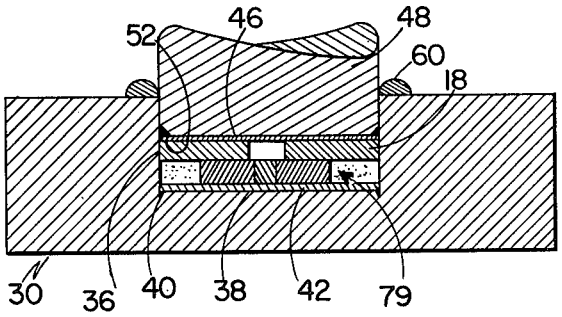
FIG. 9 is a cross-sectional view illustrating a modification of the method shown in FIG. 8.

Disc 42 of suitable brazing material is then placed on bottom 38 of cavity 36, as shown in FIG. 9. A brazing alloy supplied as EF-45 by the Handy and Harmon Company, having forty-five percent silver, fifteen percent copper, sixteen percent zinc and twenty-four percent cadmium has been found to be suitable. In a physical embodiment, disc 42 was 0.005 inch thick with an outside diameter about 0.005 inch smaller than the inside diameter of cavity 36. Die blank-plate assembly 79 is then positioned in casing cavity 36 with its side 24 engaging bottom 38 and die blank 10, 10′, 10″ facing cavity 36, as shown in FIG. 7; however, assembly 79 may be reversed so die blank 10, 10′, 10″ faces bottom 38 of cavity 36.

Layer 44 of powdered metal is then deposited in cavity 36 covering die blank-plate assembly 79. In a specific embodiment, powdered metal 44 consisted of a mixture of forty percent copper, forty percent nickel and twenty percent brazing alloy powder similar to that employed for brazing disc 42. Another brazing disc 46, substantially identical to brazing disc 42, is then placed over layer 44 of powdered metal.

Cylindrical metal plug 48 is provided having top and bottom end 50, 52. Plug 48 has cylindrical cavity 54 formed in its bottom end 52, the inside diameter of cavity 54 being greater than the maximum transverse dimension of die blank 10, 10′, 10″ and preferably at least substantially equal in depth to the thickness of die blank 10, 10′, 10″. The outside diameter of plug 48 is proportioned to have a close fit with cavity 36. In a physical embodiment, the outside diameter of plug 48 was 0.002 inch smaller than the inside diameter of cavity 36. Cavity 54 defines annular flange 56. Cavity 54 is provided in order to provide greater consolidation of powdered metal 44 in space 58 between annular flange 56 and side 22 of centering plate 18, 18′ after assembly of the die, as shown in FIG. 7, which aids in more securely locking die blank 10, 10′,10″ and plug 48 in the completed assembly. It will be understood, however, that plug cavity 54 may be eliminated, if desired, as shown in FIG. 9, in which case, the locking effect may be reduced. Plug 48 is preferably formed of stainless steel; however, other metals can be employed for casing 30 and plug 48 as long as they are compatible with and will bond to the brazing alloy employed for brazing discs 42, 46.

Ring 60 of flux is then applied on front side 32 of casing 30 around plug 48. Flux type DB supplied by Handy and Harmon Company has been found to be suitable.

Pressure is then applied to end 50 of plug 48, as by ram 62 and simultaneously casing 32 and plug 48 are heated, as by induction heating, for a time and at a temperature sufficient to melt the brazing alloy component of powdered metal 44 and both brazing discs 42, 46. In a specific embodiment of the invention, a force about one-thousand pounds was applied to plug 48 and a temperature of about 1300° F. was employed. Substantially higher temperatures and forces can result in damage to die blank 10, 10', 10''.

Following the heating of casing 30 and plug 48, approximately one-half minute of time in a specific embodiment, heating is terminated and casing 30 and plug 48 allowed to cool; however, pressure is preferably maintained on plug 48 until the assembly is cooled below 1000° F. or the brazing alloy 42, 46 has solidified. Typically, all of the excess brazing alloy and flux is forced out of the chamber defined by plug cavity 54 and centering plate 18, 18' and is concentrated around plug 48, being found at the junction of plug 48 and casing 30 on front side 32, as shown at 64 in FIG. 7.

It will be understood that cooling of casing 30 and plug 48 results in solidifying the partially molten powdered metal 44 to form body 44' of consolidated metal encapsulating die blank 10, 10',10''. Following cooling, end 50 of plug 48 is machined so as to be flush with front side 32 of casing 30, as shown in FIG. 7. In the finished wire drawing die, gap 66 between plug cavity 54 and side 14 of die blank 10, 10' is relatively narrow, i.e., about 0.010–0.015 inch in a specific embodiment. It has been found that there is little or no porosity in the solidified powdered metal body 44' in gap 66 and in space 58 between side 24 of centering plate 18, 18' and edge 68 of annular flange 56. However, some porosity is found in annular space 70 between die blank 10, 10', 10'' and annular flange 56. The minimal porosity, i.e., improved solidified powdered metal quality in gap 66 above core 12 reduces the possibility of erosion during wire drawing. Furthermore, the improved powder metal quality in gap 58 assists in locking die blank 10, 10', 10'', centering plate 18, 18' and plug 48 in cavity 36 of casing 30.

Figure 8:
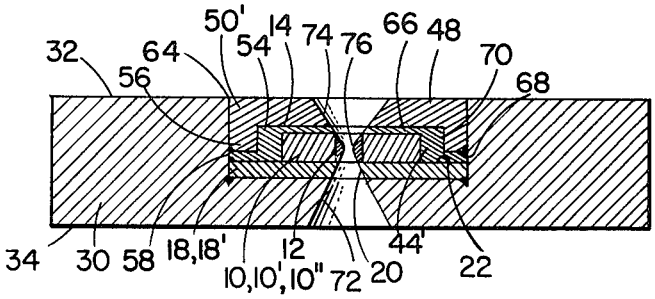
FIG. 8 is a cross-sectional view showing the finished wire drawing die of the invention.

Finally, countersunk opening 72 is formed in back side 34 of casing 30 concentric with opening 20 and core 12 or die blank 10'' and extends to core 12, and countersunk opening 74 is formed in flush end 50' of plug 48 through solidified metal body 44' in gap 66 to core 12, and die opening 76 is drilled through core 12 or die blank 10'' to provide the completed wire drawing die generally shown at 78 in FIG. 8.

Figure 10:
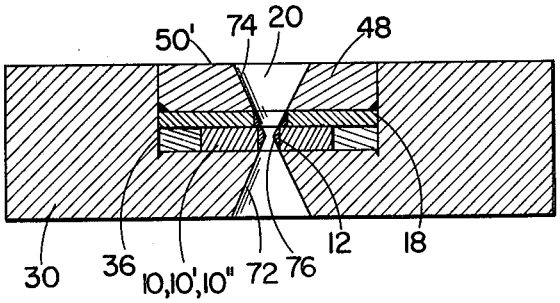
FIG. 10 is a cross-sectional view showing the finished wire drawing die resulting from the method of FIG. 9.

It will be understood that the powdered metal layer 44 may be eliminated and the centering plate 18, 18' secured in cavity 36 by brazing alloy alone as shown in FIG. 9; however, the use of powdered metal layer 44 is preferred. FIG. 10 shows the finished wire drawing die 78' resulting from the modified method of FIG. 9. Center opening 20 in centering plate 18 may be eliminated, as shown in FIG. 3B, in which case, die blank 10'' is centered on centering plate 18 by the use of a toolmaker's alignment microscope and secured to plate 18' by suitable adhesive. It will be understood further that centering plate 18, 18' may be formed of brazing material.

It will now be seen that the invention provides a fast, accurate method of locating either single layered, multilayered or cored die blanks, or natural diamonds in the cavity of a die casing.

While there have been described above the principles of this invention in connection with specific apparatus, it is to be clearly understood that this description is made only by way of example and not as a limitation to the scope of the invention.

what is claimed is:

1. A method of making a wire drawing die comprising the steps of: providing a circular metal plate; centering a die element with respect to said plate and adhering the same to a side thereof to form a die element-plate assembly; providing a metal die casing having front and back sides and forming a cyclindrical cavity in said front casing side having a substantially flat bottom spaced from said back casing side; placing a first layer of brazing material on said cavity bottom; placing said assembly concentrically in said cavity on said first brazing material layer; placing a second layer of brazing material over said assembly; providing a cyclindrical metal plug having opposite ends and an outside diameter proportioned to have a close fit with said cavity; inserting said plug in said cavity with said one end thereof defining a chamber with said cavity bottom which extends diametrically thereacross and with said plate and die element assembly disposed therein; said forming step including proportioning the diameter of said casing cavity to accommodate said plate with a close fit; securing said plate and die element assembly in said chamber by applying heat and pressure to said plug and casing thereby to melt said brazing material; forming countersunk openings in said back casing side and the other end of said plug which respectively extend to said die element; and drilling a die opening through said die element communicating with said countersunk openings.

2. The method of claim 1 wherein said die element has an irregular shape.

3. The method of claim 1 wherein said die element includes synthetic, hard, wear-resistant material.

4. The method of claim 1 wherein said die element includes a natural, hard, wear-resistant material.

5. The method of claim 1 wherein said plate has a coaxial opening therethrough, said centering step comprising visually centering said die element with respect to said plate opening.

6. The method of claim 1 wherein said plate is imperforate.

7. The method of claim 1 comprising the further step of depositing a layer of metal powder in said cavity covering said assembly; said securing step comprising applying pressure to the other end of said plug thereby to compress said metal powder layer, simultaneously heating said casing and plug for a time and at a temperature sufficient to at least partially melt said powder to form a body of consolidated metal filling said chamber and encapsulating said die element, and terminating said heating and pressure and cooling said casing and plug to solidify said metal body.

8. The method of claim 7 wherein said die element includes a blank having flat opposite sides and a cylindrical core formed of synthetic hard wear-resistant material, said core being centered with respect to said plate during said centering step, said countersunk openings extending respectively to said core, said die opening being drilled through said core.

9. The method of claim 8 wherein said die element faces said front casing side, said step of providing a metal plug includes forming a cylindrical cavity in said one end of said plug, the diameter of said plug cavity being proportioned to accommodate said die element.

10. The method of claim 8 wherein said blank has an irregular shape, said plate having a coaxial opening therethrough having a diameter greater than the diameter of said core, said centering step comprising visually centering said core with respect to said plate opening.

11. The method of claim 10 comprising the further steps of supporting one side of said blank on a fixture and exerting a vacuum thereon, and applying adhesive to said other side of said blank, said centering step comprising supporting said plate in closely spaced relation with said other side of said blank while manipulating said plate to center said opening with respect to said core, said adhering step comprising pressing the centered plate against said other side of said blank.

12. The method of claim 7 or 11 wherein said metal powder is deposited on said first brazing material layer, said second layer of brazing material being placed on said metal powder layer.

13. The method of claim 12 wherein said brazing material layers respectively comprise preformed thin, circular discs.

14. The method of claim 12 wherein said die element faces said front casing side, the diameter of said plug cavity being greater than the maximum transverse dimension of said die element and the depth of said plug cavity is at least equal to the thickness of said die element.

15. The method of claim 12 comprising the further step of placing flux on said front side of said casing around said plug prior to said application of pressure and heating step.

16. The method of claim 12 wherein said casing cavity forming step includes undercutting said bottom adjacent the side wall thereof.

17. The method of claim 7 wherein said plate is formed of brazing material.

18. A wire drawing die comprising: a metal casing having front and back sides, said front casing side having a cylindrical cavity formed therein with a substantially flat bottom spaced from said back casing side; a cylindrical metal plug closely fitted in said casing cavity and having opposite ends, one of said plug ends facing and being spaced from said casing cavity bottom thereby defining a chamber extending across said cavity; a circular metal plate closely fitted in said chamber and having opposite sides; a die element in said chamber centered on one side of said plate and adhered thereto; means for securing said plate and die element in said chamber; said back side of said casing having a countersunk opening extending therethrough to said die element, the other end of said plug having a countersunk opening extending therethrough to said die element, said die element having a die opening therethrough communicating between said countersunk openings.

19. The die of claim 18 wherein the other side of said plate faces said cavity bottom and said die element faces said front casing side.

20. The die of claim 18 wherein said die element has an irregular shape.

21. The die of claim 18 wherein said die element includes synthetic, hard, wear-resistant material.

22. The die of claim 18 wherein said die element includes a natural, hard, wear-resistant material.

23. The die of claim 18 wherein said die element includes a metal blank having flat opposite sides and a cylindrical core formed of synthetic hard wear-resistant material, one side of said blank being adhered to said other side of said plate element, said core being centered with respect to said plate, said countersunk openings respectively extending to said core, said die opening being formed in said core.

24. The die of claim 23 wherein said blank has an irregular shape.

25. The die of claims 18, 23 or 24 wherein said securing means comprises a body of solidified metal filling said chamber encapsulating said die element and securing said plug in said cavity.

26. The die of claim 25 wherein said plug has a cylindrical cavity formed in said one end thereof and defining said chamber, said plug cavity defining an annular flange with the side wall of said plug, said annular flange having an end spaced from said casing cavity bottom, said metal body filling said space.

27. The die of claim 26 wherein said blank faces said front casing side, the diameter of said plug cavity being greater than the maximum transverse dimension of said blank, the depth of said plug cavity being at least substantially equal to the thickness of said blank.

28. The die of claim 26 wherein said casing cavity bottom includes an annular undercut adjacent the side wall thereof.

29. The die of claim 26 wherein said plate has a central opening therein concentric with said countersunk openings and said die opening.

30. The method of claim 1 wherein said die element faces said casing cavity bottom and the other side of said plate faces said front casing side.

31. The method of claim 30 wherein said second layer of brazing material is placed on the side of said plate which faces said front casing side.

32. The die of claim 18 wherein said die element faces said casing cavity bottom and the other side of said plate faces said front casing side.

* * * * *